US009404711B1

(12) United States Patent
Hartley et al.

(10) Patent No.: US 9,404,711 B1
(45) Date of Patent: Aug. 2, 2016

(54) REUSABLE LASER SIGHTING DEVICE ADAPTER FOR ROCKET LAUNCHER

(71) Applicant: Crimson Trace Corporation, Wilsonville, OR (US)

(72) Inventors: Scott Hartley, Wilsonville, OR (US); James McDonald, Wilsonville, OR (US); Dale Suzuki, Wilsonville, OR (US); Dee Swartz, Wilsonville, OR (US); Jeff Hoblitt, Wilsonville, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 164 days.

(21) Appl. No.: 13/916,411

(22) Filed: Jun. 12, 2013

Related U.S. Application Data

(60) Provisional application No. 61/658,790, filed on Jun. 12, 2012.

(51) Int. Cl.
*F41G 1/22* (2006.01)

(52) U.S. Cl.
CPC ..... *F41G 1/22* (2013.01)

(58) Field of Classification Search
CPC ..... F41G 1/32; F41G 1/34; F41G 1/35; F41G 1/36; F41G 1/16; F41G 1/22
USPC ..... 42/114, 115, 117, 142
See application file for complete search history.

(56) References Cited

U.S. PATENT DOCUMENTS

| | | | | |
|---|---|---|---|---|
| 2,488,541 | A * | 11/1949 | Holme | 250/467.1 |
| 4,799,325 | A * | 1/1989 | Booze | 42/124 |
| 6,041,508 | A | 3/2000 | David | |
| 6,935,864 | B2 | 8/2005 | Schechter et al. | |
| 7,562,484 | B2 * | 7/2009 | Kim | 42/114 |
| 7,743,547 | B2 | 6/2010 | Houde-Walter | |
| 2002/0134000 | A1 | 9/2002 | Varshneya et al. | |
| 2011/0000121 | A1 | 1/2011 | Uhl | |
| 2012/0140451 | A1 * | 6/2012 | Araujo et al. | 362/103 |

FOREIGN PATENT DOCUMENTS

| | | | |
|---|---|---|---|
| GB | 11896 | * | 2/1916 |
| WO | 2014035526 | A2 | 3/2014 |

OTHER PUBLICATIONS

International Search Report in related matter PCT/US2013/045475, mailed Mar. 27, 2014.

* cited by examiner

*Primary Examiner* — Stephen M Johnson

(74) *Attorney, Agent, or Firm* — Schwabe, Williamson & Wyatt, P.C.

(57) ABSTRACT

Disclosed herein are reusable adapters for sighting devices for rocket launchers and other large weapons, particularly mounting adapters for reusable sighting devices that allow retrofitting of existing weapons inventory. Some embodiments include an adapter that includes a laser sighting device mount coupled to a mounting bracket, wherein the mounting bracket is configured to register to and align with one or more housing features of the rocket launcher. In various embodiments, the adapter also includes a strap member configured to secure and immobilize the adapter in position on the rocket launcher. In various embodiments, the laser sighting device mount may be factory calibrated with respect to the adapter, and therefore once the adapter has been mounted on the rocket launcher, no field calibrations of the laser sighting device are necessary.

14 Claims, 14 Drawing Sheets

REUSABLE LASER SIGHTING DEVICE ADAPTER FOR ROCKET LAUNCHER

CROSS REFERENCE TO RELATED APPLICATIONS

The present application claims priority to U.S. Patent Application No. 61/658,790, filed Jun. 12, 2012, entitled "REUSABLE LASER SIGHTING DEVICE ADAPTER FOR ROCKET LAUNCHER," the disclosure of which is hereby incorporated by reference in its entirety.

TECHNICAL FIELD

Embodiments herein relate to sighting devices for rocket launchers and other large weapons, and more particularly to reusable sighting devices and mounting members that allow retrofitting of existing weapons inventory.

BACKGROUND

Rocket launchers include shoulder-launched missile weapons, which category encompasses any weapon that fires a rocket-propelled projectile at a target, yet is small enough to be carried by a single person and fired while held on one's shoulder. Specific types of rocket launchers within this group include the rocket-propelled grenade, better known as the RPG, which is a type of shoulder-launched anti-tank weapon; the anti-tank guided missile, a guided missile primarily designed to hit and destroy heavily-armored tanks and other armored fighting vehicles; and the man-portable air-defense systems, which provide shoulder-launched surface-to-air missiles. A smaller variation is the gyrojet, a small arm rocket launcher with ammunition slightly larger than that of a 0.45-caliber pistol. Generally speaking rocket launchers fire projectiles that continue to propel themselves after leaving the barrel of the weapon. In some situations, it may be desirable to guide the aiming of a rocket launcher using a sight, such as a laser sighting device, however many rocket launchers only have traditional iron sights for daylight use.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
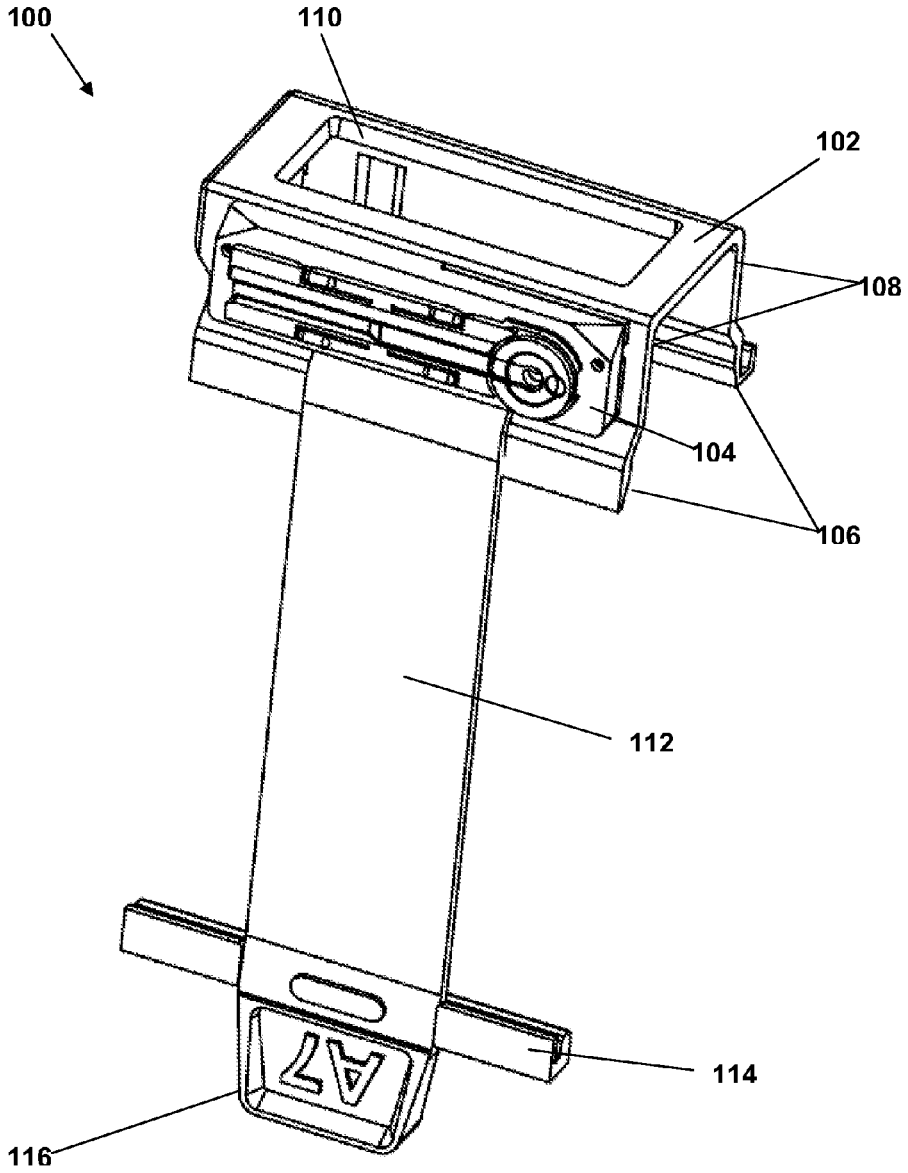
FIG. 1 is a top perspective view of a laser sight mounting adapter for removably mounting a laser sighting device to an M 72 LAW rocket launcher, with the adapter shown in an open position, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide detachable and reusable laser sighting device mounting adapters for rocket launchers, such as the M72 shoulder fire weapon, and other weapons, such as rifles, long guns, and grenade launchers, such as the 203 and 320 grenade launchers. In various embodiments, the detachable mounting adapter may allow the retrofitting of existing inventories of rocket launchers and other weapons with laser sighting devices, without costly and/or time-consuming retrofitting procedures. In various embodiments, these detachable mounting adapters may also allow a laser sighting device to be reused multiple times with a number of individual rocket launchers, conserving resources and reducing waste, and windage and elevation calibrations may not be necessary, even when the adapter is reused multiple times with different weapons.

Some embodiments of the laser sight mounting adapters disclosed herein may provide low light aiming lasers for use with rocket launchers, such as the family of M72 LAW Shoulder Fired Rocket Launchers manufactured by Nammo Tally. The M72 LAW incorporates a traditional sighting system referred to as an iron sight, which includes two alignment markers: one at the muzzle, and the other at the midpoint of the launcher. The muzzle sight is adjustable to compensate for target distance, and thus aiming the launcher requires first adjusting the muzzle sight to compensate for distance, and then visually aligning both alignment markers with the target in a single line of sight. Under daylight conditions, targeting typically is not difficult. However, under reduced ambient light conditions, targeting using an iron sight system may be extremely difficult.

In various embodiments, the disclosed laser sight mounting adapters may permit the mounting of laser sights that may facilitate low light aiming, and some embodiments may also add the benefit of instinctive targeting in low light conditions. In various embodiments, because the M72 LAW launcher tube is disposable, the laser sight may use a quick detach mount to couple the laser sight to the disclosed laser sight mounting adapters, which may be mounted on the M72 LAW tube, thus allowing an operator to easily attach the laser sight and laser sight mounting adapter to the M72 tube prior to firing, and then remove the laser sight and laser sight mounting adapter before disposing of the tube, all without having to adjust windage and/or elevation. In various embodiments, the laser sight mounting adapters disclosed herein may allow the retrofitting of existing inventories of rocket launchers and other weapons with laser sighting devices. In various embodiments, the disclosed laser sight mounting adapters also may be reused multiple times with a number of individual rocket launchers, conserving resources and reducing waste.

Furthermore, the range of the laser sights disclosed in various embodiments may be changed to suit the type of round being used. For example, in some embodiments, the range may be adjusted to a distance between 50 meters and 200 meters. Thus, in various embodiments, the quadrant and elevation values may be adjusted to suit the ballistic properties of a given munition. In some embodiments, the weight of the projectile and the propellant used may affect the quadrant and elevation values selected. For example, and A9 round may use different quadrant and elevation values than an A7 round. Thus, a single laser sighting module may be used (and reused) for a variety of different purposes in various embodiments.

In various embodiments, the laser sight mounting adapter may couple to a laser sighting device that may include one or more red lasers, green lasers, and/or infrared (IR) lasers, and that may provide aiming sights for low light conditions. In particular embodiments, the detachable laser sight mounting adapters may be used with the laser sighting device and mounts disclosed in U.S. Provisional Patent Application No. 61/610,448 and/or U.S. patent application Ser. No. 13/801,992, although other laser sighting devices and mounting members may be substituted.

Prior to the present disclosure, attaching a laser sighting device to an inventory of existing launchers entailed a multi-step protocol to permanently affix a laser sighting device range plate to each rocket launcher, and then calibrate the orientation of the range plate such that a reusable laser sighting device could be quickly and easily coupled to the range plate without the need for further calibration. Thus, the range plate mounting procedure included (1) unpacking the launcher and removing the carry sling, (2) extending the telescoping tube (and thereby partially activating the launcher), and (3) placing the launcher muzzle-end into a fixture. Once mounted into a fixture, (4) a hole would be drilled into the housing of the launcher, and (5) a through screw would attach a range plate to the launcher, which would allow for angular and azimuth calibration. Calibration would be achieved by (6) attaching a master laser and (7) aligning the range plate to a calibration target a predetermined distance from the muzzle. Once calibration was achieved, the range plate would be tacked and glued into place with epoxy. The launcher would then be removed from the fixture and the epoxy would be allowed to cure prior to repackaging.

This procedure resulted in a reusable laser sighting system that would allow a single laser sighting device to be reused multiple times with multiple rocket launchers, thus reducing waste while enhancing accuracy. However, the procedure involved with retrofitting the weapons to attach the range plate may be time consuming and expensive, and drilling the housing of a weapon that includes a live round may raise safety concerns.

Thus, disclosed in various embodiments are laser sight mounting adapters that may allow a laser sighting device to be removably coupled to a rocket launcher or other large weapon in fewer steps and without disassembling any part of the weapon or drilling any housing members. FIG. 1 is a top perspective view of a laser sight mounting adapter for removably mounting a laser sighting device to an M 72 LAW rocket launcher, with the adapter in an open position, in accordance with various embodiments. In the illustrated embodiment, the adapter 100 includes a mounting bracket 102 with a laser sighting device mount 104 mounted thereupon. In various embodiments, laser sighting device mount 104 may allow a laser sighting device (not shown) to be coupled and uncoupled from adapter 100 as described in detail and shown in FIGS. 12A-12E, below. As is also described in greater detail below, once laser sighting device mount 104 has been factory calibrated for windage and elevation with respect to mounting bracket 102, no further calibrations are necessary.

In various embodiments, mounting bracket 102 may include at least one primary registration surface 106 that may allow mounting bracket 102 to be reliably and reproducibly positioned on the rocket launcher housing to ensure proper calibration of the laser sighting device relative to the rocket launcher. Some embodiments also may include secondary registration surfaces 108, which in the illustrated embodiment may mate with and/or engage a housing member for an iron sight. Some embodiments may further include additional registration surfaces, such as a third registration surface, fourth registration surface, or fifth registration surface, which may mate with and/or engage additional surfaces of the iron sight housing member or the rocket launcher housing. Additionally, some embodiments may have one or more cutouts 110 for accommodating features of the rocket launcher, such as a pop-up iron sight for use in daylight operation.

Various embodiments of adapter 100 also may include a securing member, such as elastomeric strap 112. In various embodiments, strap 112 may wrap around the muzzle of the rocket launcher to aid in securing adapter 100 in position during transport and use. In some embodiments, a fastening member 114 may be provided on strap 112 for securing strap 112 in position about the muzzle of the rocket launcher. In some embodiments, a tab 116 also may be provided on strap 112 in order to facilitate fastening and unfastening of strap 112 about the muzzle of the rocket launcher. Although strap 112 is depicted as an elastomeric strap in the illustrated example, one of skill in the art will appreciate that other, non-elastomeric materials may be used to form strap 112. For example, in some embodiments, nylon webbing, leather, plastic, or any other pliable material may be substituted. In some embodiments, fastening member 114 may be replaced by another type of fastener, such as a D-ring or other loop mounted on mounting bracket 102, for instance combined with a snap, hook-and-loop-type fastener, such as Velcro™, or other closure mechanism to secure strap 112 about the muzzle of the rocket launcher.

Figure 2:
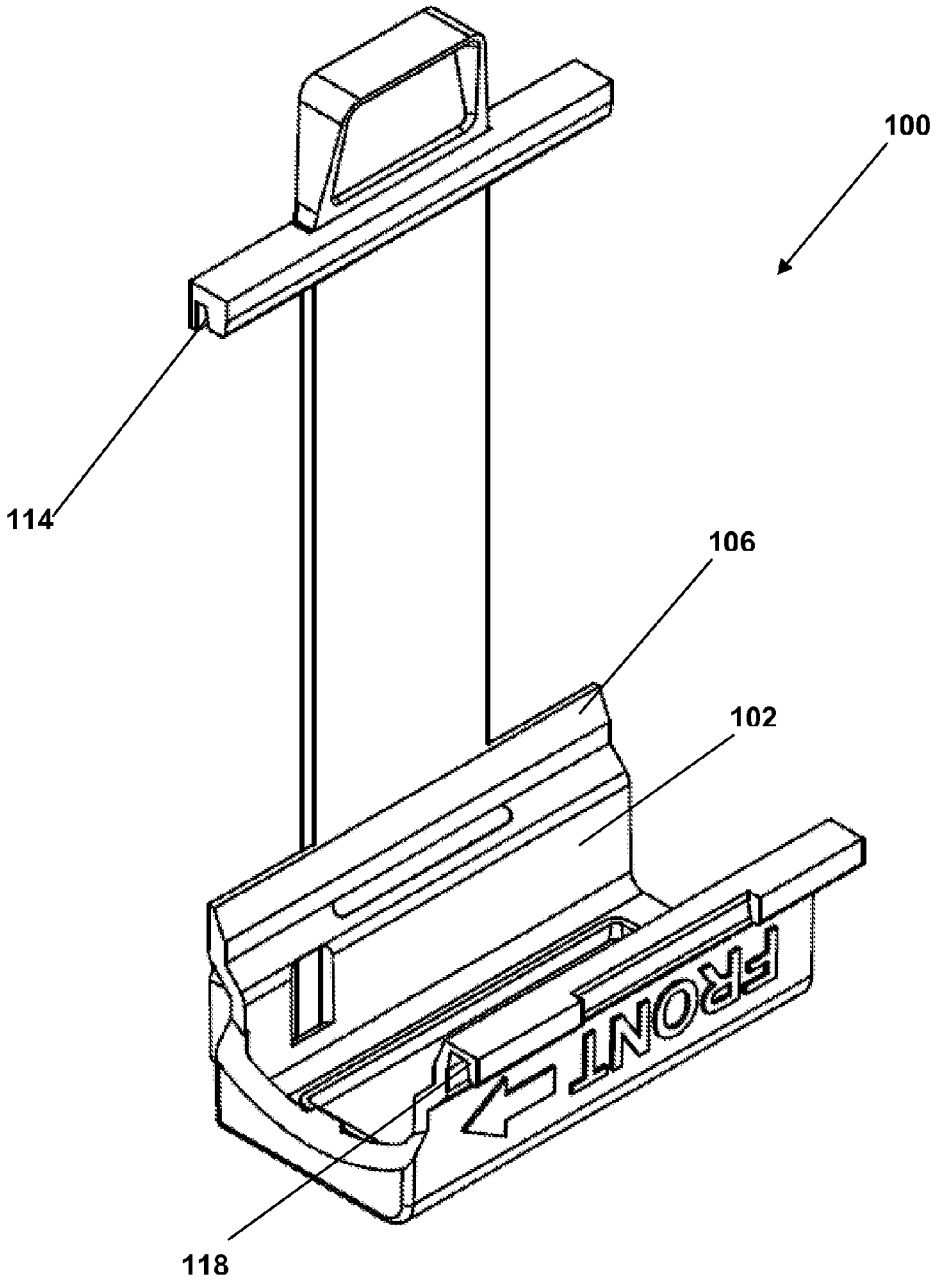
FIG. 2 is a bottom perspective view of the adapter of FIG. 1 in an open position, in accordance with various embodiments.

FIG. 2 is a bottom perspective view of the adapter of FIG. 1 in an open position, in accordance with various embodiments. In the illustrated example of adapter 100, fastening member 114 is configured as a hook that is adapted to couple to a corresponding lip 118 on the opposite side of mounting bracket 102. Primary registration surface 106 is also visible on the underside of mounting bracket 102.

Figure 3A:
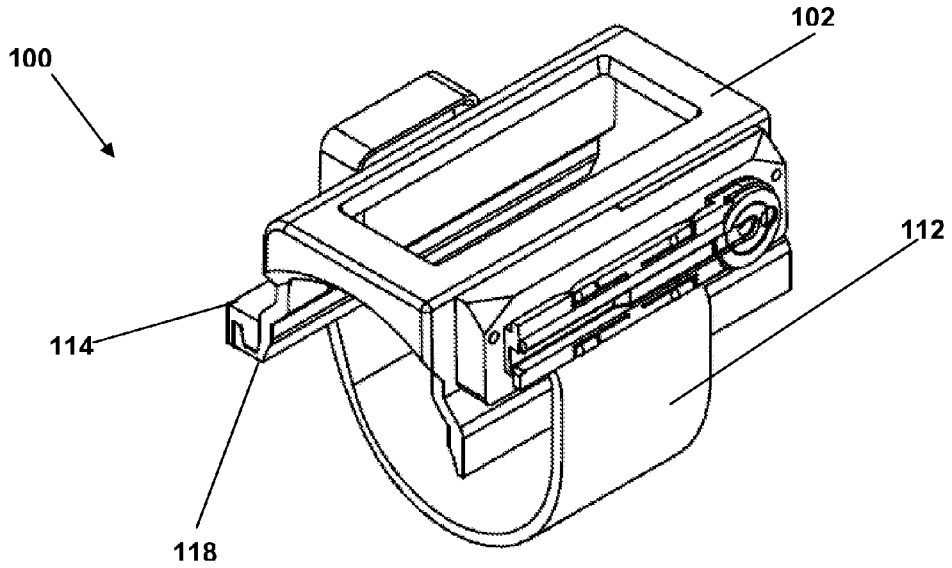
FIGS. 3A, 3B and 3C are top (FIG. 3A) and bottom (FIG. 3B) perspective views and a side view (FIG. 3C) of the adapter of FIG. 1 in a closed position, in accordance with various embodiments.
Figure 3B:
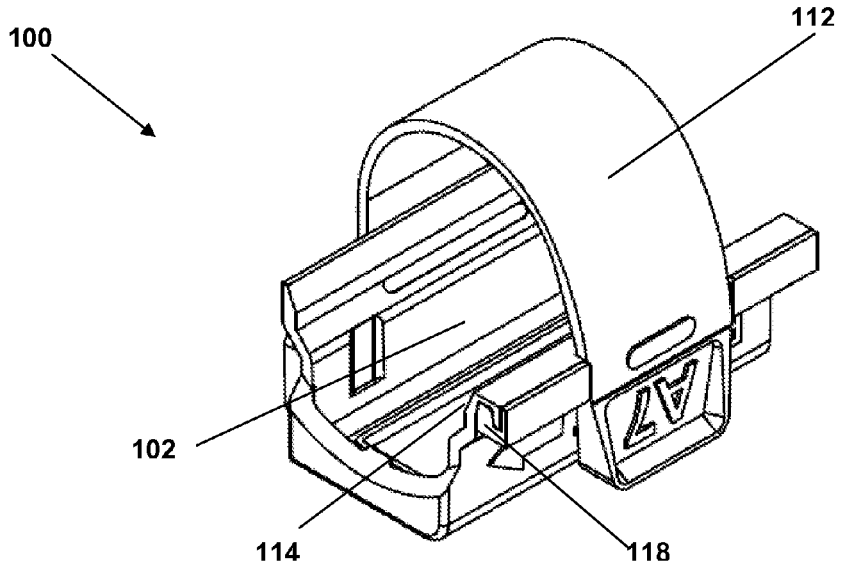
Figure 3C:
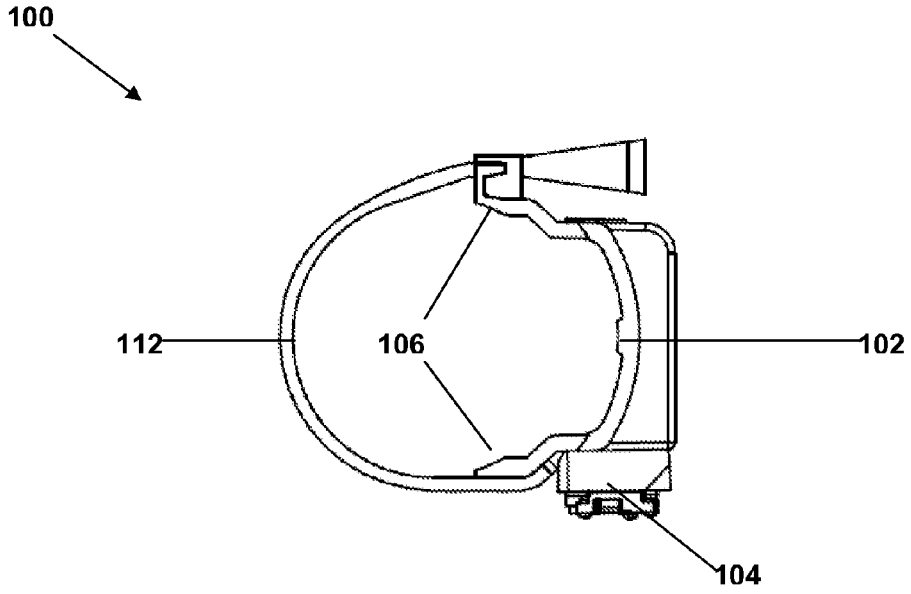

FIGS. 3A, 3B and 3C are top (FIG. 3A) and bottom (FIG. 3B) perspective views and a side view (FIG. 3C) of the adapter of FIG. 1 in a closed position, in accordance with various embodiments. As illustrated in FIGS. 3A and 3B, fastening member 114 may be configured to couple securely to corresponding lip 118 on mounting bracket 102. In some embodiments, when strap 112 is stretched around the muzzle of the rocket launcher, the pressure from the elastomeric material may provide sufficient force to retain fastening member 114 in a closed position. FIG. 3C shows the position of primary registration surfaces 106 on the underside of mounting bracket 102 and opposite strap 112 in adapter 100. In the illustrated embodiment, laser sighting device mount 104 is shown as being located on a side surface of mounting bracket 102. In other embodiments, laser sighting device mount 104 may be positioned elsewhere on mounting bracket 102, such as on the opposite side or top.

Figure 4:
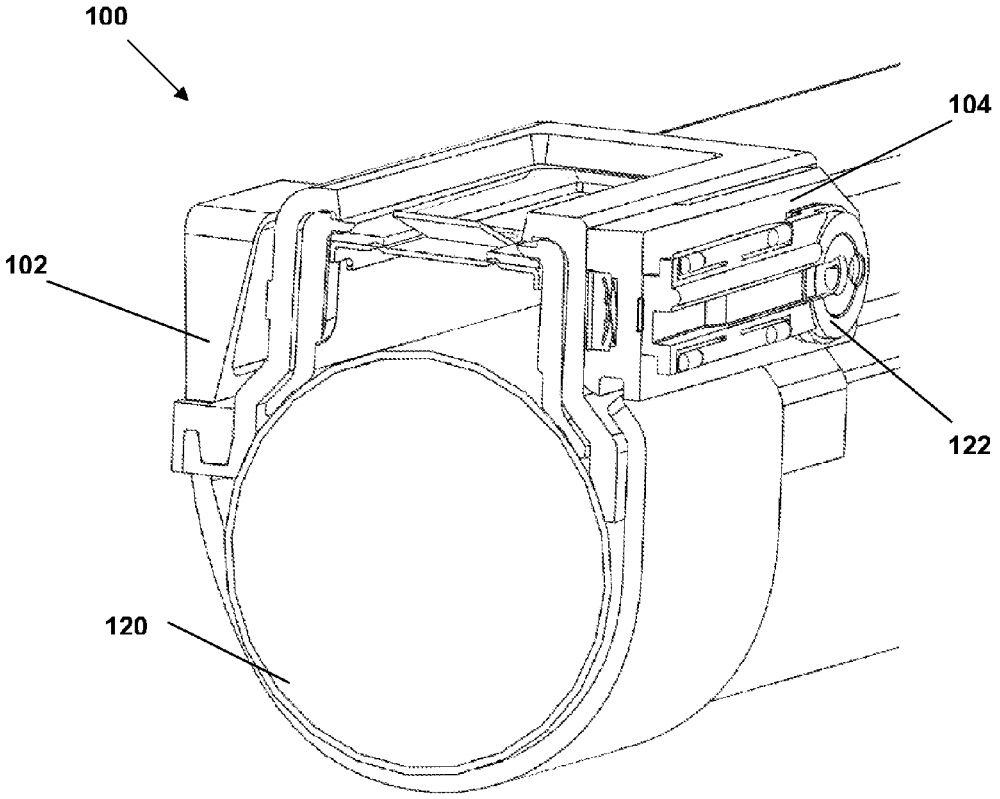
FIG. 4 is a cross-sectional view of the adapter of FIG. 1, shown coupled to an M 72 LAW rocket launcher, in accordance with various embodiments.

FIG. 4 is a cross-sectional view of the adapter of FIG. 1, shown coupled to an M 72 LAW rocket launcher, in accordance with various embodiments. In the illustrated embodiment, adapter 100 includes a mounting bracket 102 coupled to a laser sighting device mount 104. As described above, in various embodiments, a laser sighting device (not shown) may be detachably mounted to the muzzle 120 of a rocket launcher via laser sighting device mount 104, which may function as a fixed base plate. In some embodiments, the laser device and/or adapter 100 may be detached from a spent rocket launcher and coupled to a new rocket launcher multiple times. For instance, in some embodiments, the laser device also may be uncoupled from laser sighting device mount 104 and coupled to a new laser sighting device mount 104 on a new adapter 100. In other embodiments, the entire adapter 100 may be detached from a spent rocket launcher and coupled to a new rocket launcher. Thus, in various embodiments, the laser device and/or adapter may be removed and reused over and over again, saving money.

In specific embodiments, laser sighting device mount 104 may include one or more cams 122 at the aft end of laser sighting device mount 104. Because different variants of different rocket launchers, such as the M 72 LAW, may have different ballistic properties, in various embodiments, the one or more cams 122 may be machined to coincide with the type of round and the range settings on the laser device. Thus, in various embodiments, the quadrant and elevation values may be adjusted for a given munition. For example, in some embodiments, the weight of the projectile and the propellant used may affect the quadrant and elevation values selected. For example, and A9 round may use different quadrant and elevation values than an A7 round. Adjustment of the laser sighting device mount 104 is discussed below in greater detail with respect to FIGS. 12A-12E.

In some embodiments, one of several different settings may be selected with an adjustment knob on the laser sighting device (not shown). In some embodiments, the laser device may include a plurality of preset quadrant and elevation factory settings. For example, in one specific, non-limiting example, the device may include five different factory settings, and the correct setting may be selected for a given rocket launcher. In some embodiments, the range of the device may be between about 50 and about 200 yards.

Figure 5:
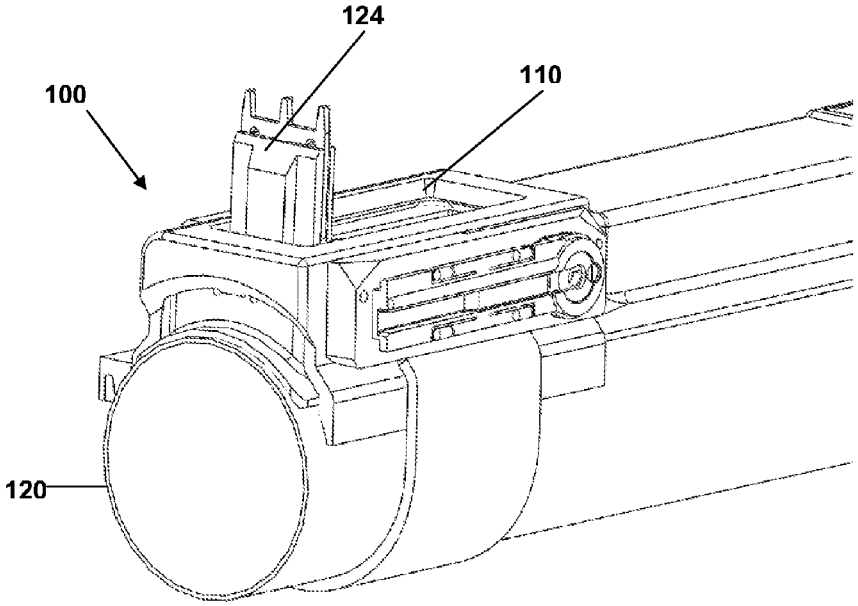
FIG. 5 is a close-up perspective view of the adapter of FIG. 1, shown coupled to an M 72 LAW rocket launcher, with the iron sight in an open position, in accordance with various embodiments.

In some embodiments, adapter 100 may be configured to accommodate certain features or pre-installed accessories on the rocket launcher. FIG. 5 is a perspective view of the adapter of FIG. 1, shown coupled to an M 72 LAW rocket launcher, with the iron sight in an open position, in accordance with various embodiments. In the illustrated example, adapter 100 may include a cutout 110 that may be configured to accommodate an iron sight 124 in the open and activated position. Thus, in various embodiments, iron sight 124 may be used for aiming in daylight conditions, and the laser sighting device may be used for aiming in low light or no light conditions. Although cutout 110 is configured to accommodate the iron sight in the illustrated embodiments, in other embodiments cutouts may be provided to accommodate other accessories and features, such as sling members, housing members, and rail members.

Figure 6:
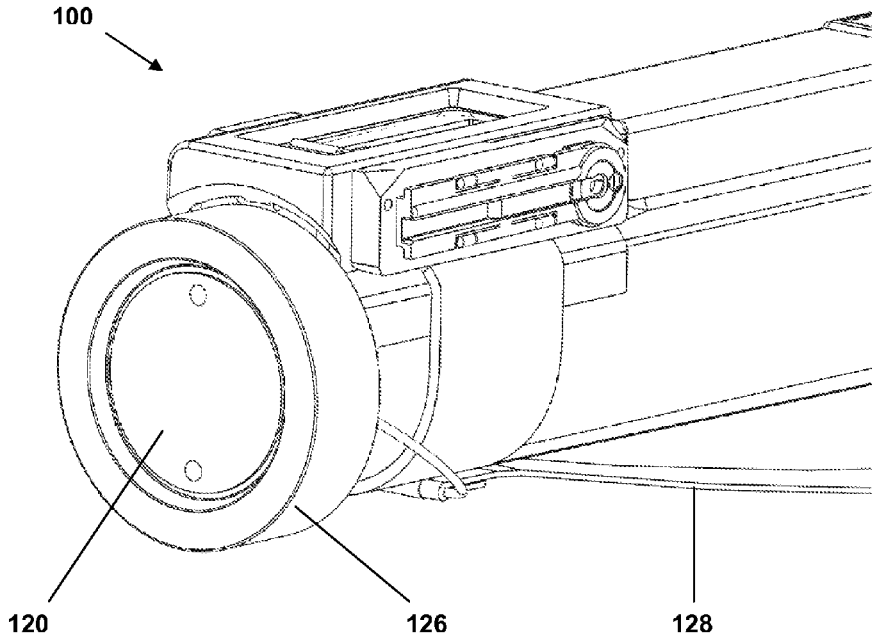
FIG. 6 is a close-up perspective view of the adapter of FIG. 1, shown coupled to an M 72 LAW rocket launcher, with a carrying sling in place, in accordance with various embodiments.
Figure 7:
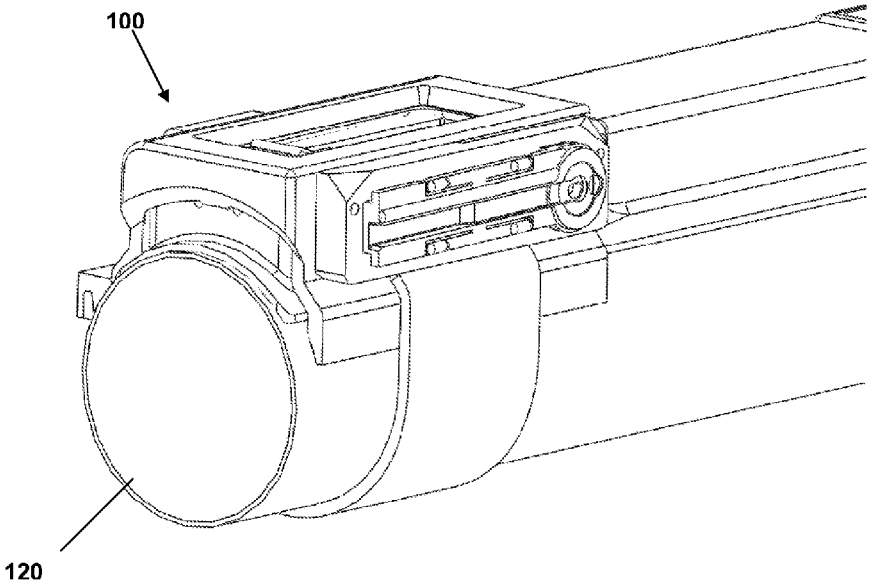
FIG. 7 is a close-up perspective view of the adapter of FIG. 1, shown coupled to an M 72 LAW rocket launcher, with the carrying sling removed, in accordance with various embodiments.

FIG. 6 is a perspective view of the adapter of FIG. 1, shown coupled to an M72 LAW rocket launcher, with an end cap and carrying sling in place, in accordance with various embodiments. In the illustrated embodiment, adapter 100 is configured to be used with the end cap 126 and carrying sling 128 in place. In specific embodiments, adapter 100 may be mounted on the rocket launcher muzzle 120 without removing carrying sling 128. FIG. 7 is a perspective view of adapter 100, shown coupled to muzzle 120 of an M 72 LAW rocket launcher, with the carrying sling removed, in accordance with various embodiments.

Figure 8:
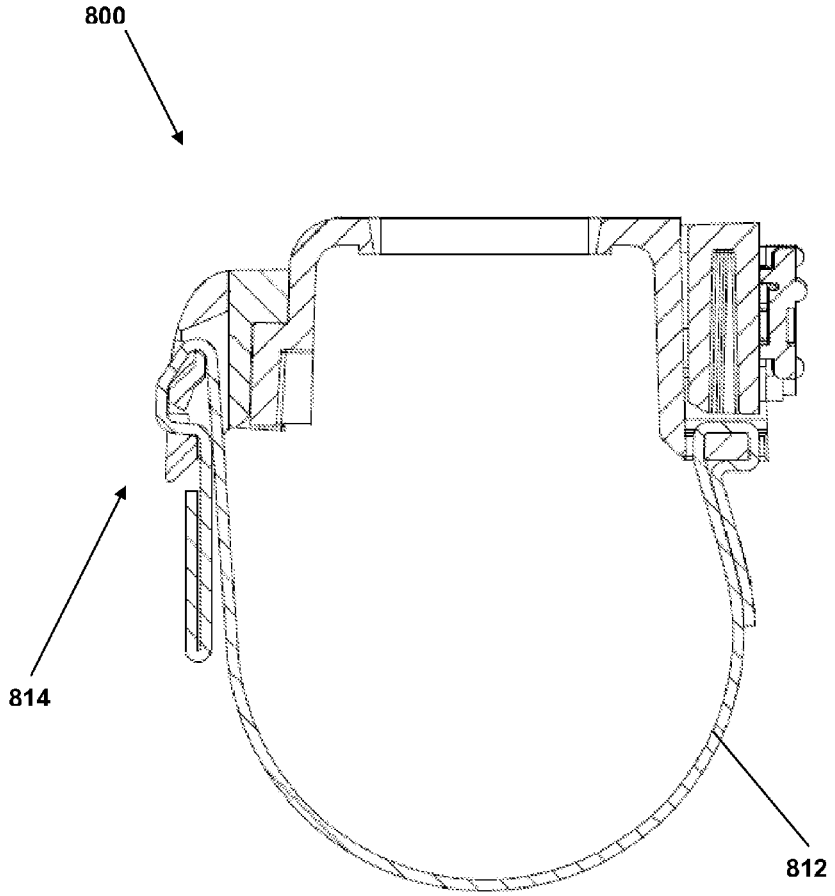
FIG. 8 is a cross-sectional view of another embodiment of a laser sight mounting adapter for removably mounting a laser sighting device to an M 72 LAW rocket launcher, in accordance with various embodiments.
Figure 9:
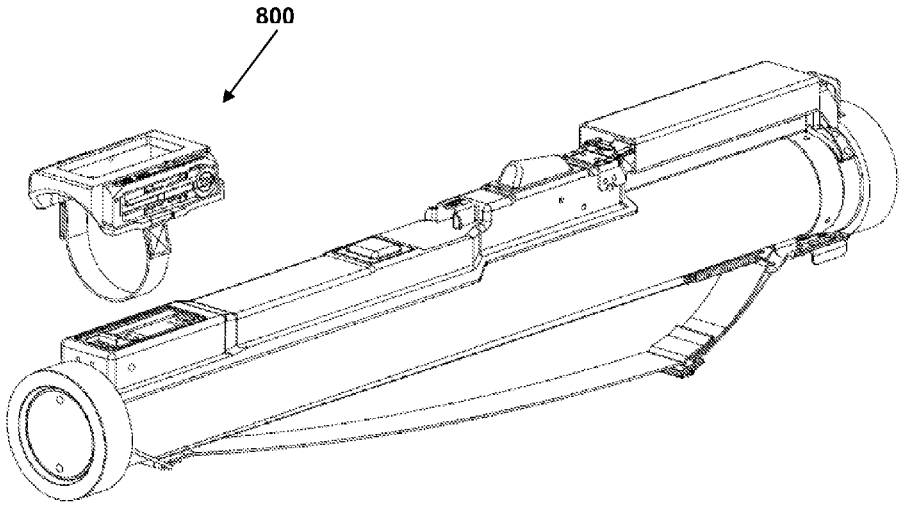
FIG. 9 is a perspective view of the adapter of FIG. 8, shown prior to mounting on the rocket launcher, in accordance with various embodiments.
Figure 10:
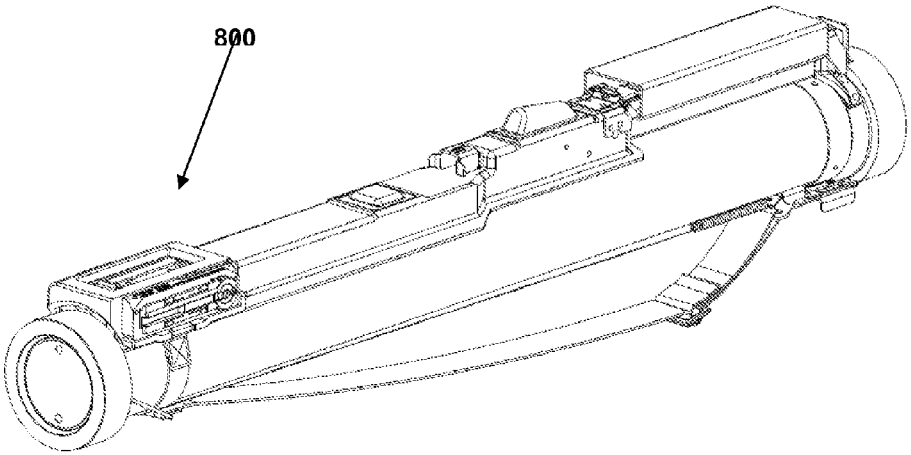
FIG. 10 is a perspective view of the adapter of FIG. 8, shown mounted on the rocket launcher, in accordance with various embodiments.
Figure 11:
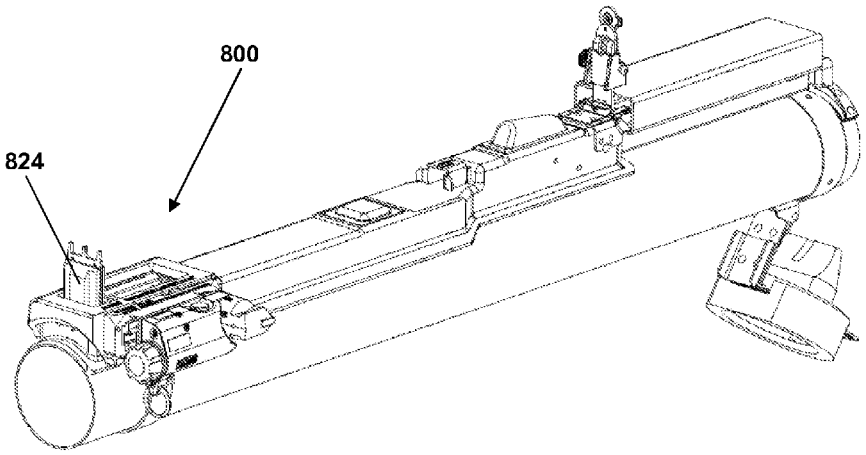
FIG. 11 is a perspective view of the adapter of FIG. 8, shown with the iron sight in an open position, in accordance with various embodiments.

FIG. 8 is a cross-sectional view of another embodiment of an adapter 800 for removably mounting a laser sighting device to an M72 LAW rocket launcher, in accordance with various embodiments. As can be seen in FIG. 8, in this embodiment, strap 812 secures adapter 800 about the rocket launcher using a different fastening member 814. FIG. 9 is a perspective view of the adapter 800 of FIG. 8, shown prior to mounting on the rocket launcher, FIG. 10 is a perspective view of the adapter of FIG. 8, shown mounted on the rocket launcher, and FIG. 11 is a perspective view of the adapter of FIG. 8, shown with the iron sight 824 in an open position, all in accordance with various embodiments.

FIGS. 12A-12E are five views of a mount for use in accordance with various embodiments, including a top view (FIG. 12A), a right side view (FIG. 12B), a left side view (FIG. 12C), a left side partial cutaway view (FIG. 12D), and a cross-sectional view (FIG. 12E), in accordance with various embodiments. As described above, in various embodiments, a laser module may be detachably mounted to a rocket launcher via a mount 1204, an example of which is illustrated in FIGS. 12A-12E. In various embodiments, a mount 1204 may be coupled to laser sighting device adapter, such as the adapter 100, 800 illustrated in FIGS. 1-11, for example by a permanent coupling mechanism, and a laser sighting device may be removably coupled to mount 1204.

Figure 12A:
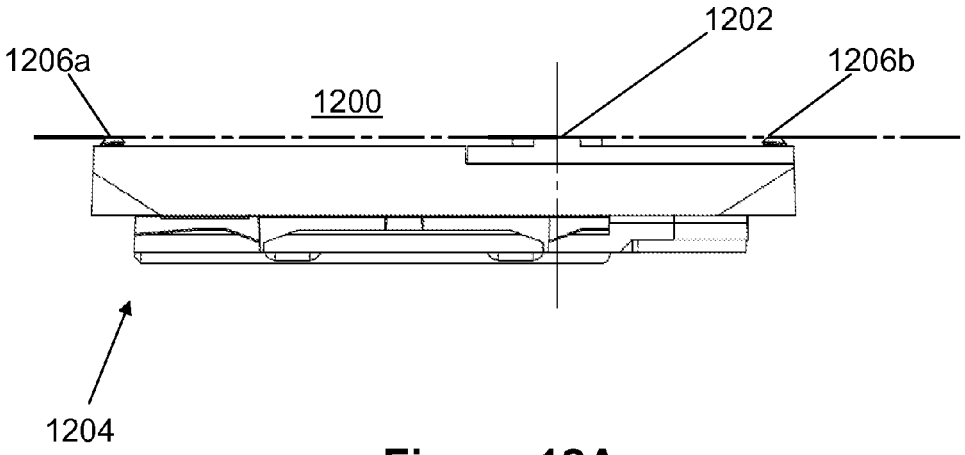
FIGS. 12A-12E are five views of a mount for use in accordance with various embodiments, including a top view (FIG. 12A), a right side view (FIG. 12B), a left side view (FIG. 12C), a left side partial cutaway view (FIG. 12D), and a cross-sectional view (FIG. 12E), in accordance with various embodiments.

In the embodiment illustrated in FIGS. 12A-12E, the side of mount 1204 that faces adapter 1200, which in the illustrated embodiment is the top side, may include a raised fulcrum point 1202 that comes in direct contact with the adapter 1200 (see, e.g., FIG. 12A). Azimuth adjustment screws 1206*a*, 1206*b* may also be provided near each end of mount 1200, and may be used to calibrate the azimuth by pivoting mount 1204 on fulcrum 1202.

Figure 12B:
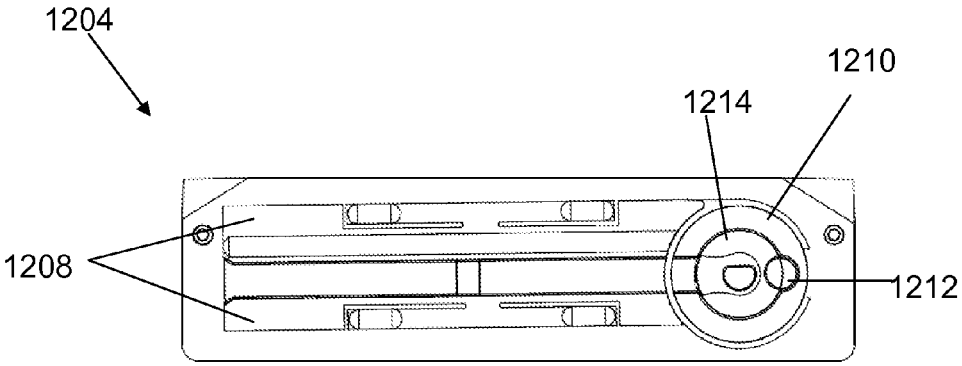

Turning now to FIG. 12B, in various embodiments, the front side of mount 1204 may include one or more rail mounting members 1208 that may be configured to couple securely with mount gripping features 110 on the laser sighting device. Also visible in this view in FIG. 12B is a rotating docking hub 1214, which may serve as the point of engagement for a registration shaft coupling the laser module with the internal cam (1220, see FIG. 12D, discussed below). Also visible in FIG. 12B is an alignment marker 1212, which may serve as a visual check to ensure that mount 1204 is in the default load-and-unload position, which in the illustrated example is the 100 meter position. In some embodiments, a portion of alignment marker 1212 may be on the rotating docking hub 1214, and another portion may be on the stationary hub 1210. In various embodiments, the two portions of alignment marker 1212 may be aligned when mount 1204 is in the default position.

Figure 12C:
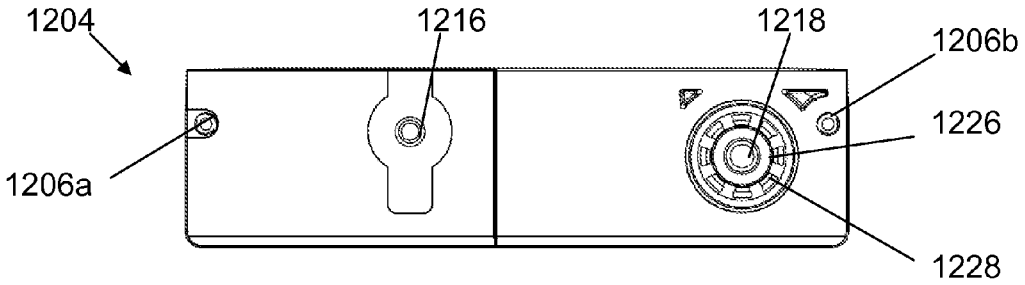

FIG. 12C is a left side view of mount 1204, and shows the side that faces the adapter 1200 when mounted (e.g., see FIG. 12A). In some embodiments, an attachment screw 1216 may be visible from the left side, may serve as a point of elevation adjustment (e.g., as fulcrum point 1202, see FIG. 12A), and may be received by a corresponding mounting screw hole on the rocket launcher body. In some embodiments, attachment screw 1216 may serve as a temporary attachment point during calibration and bonding of the laser sight, as described in greater detail below. For example, in some embodiments, the process of coupling of mount 1204 to adapter 1200 may include a temporary attachment step, and when mount 1204 is temporarily attached to the rocket launcher body by attachment screw 1216, attachment screw 1216 may serve as a point of rotation for elevation adjustment during the calibration process. Also visible in this view in various embodiments are azimuth adjustment screws 1206*a*, 1206*b*, and pivot point 1218, about which the rail mounting members (1208, see FIG. 12B) may pivot during elevation adjustments, as described in greater detail below. In various embodiments, a disk spring 1226 and corresponding self locking retaining ring 1228 may be provided to create a preload and create tension between pivot point 1218 and mount 1204, thus removing any tolerance gaps.

Figure 12D:
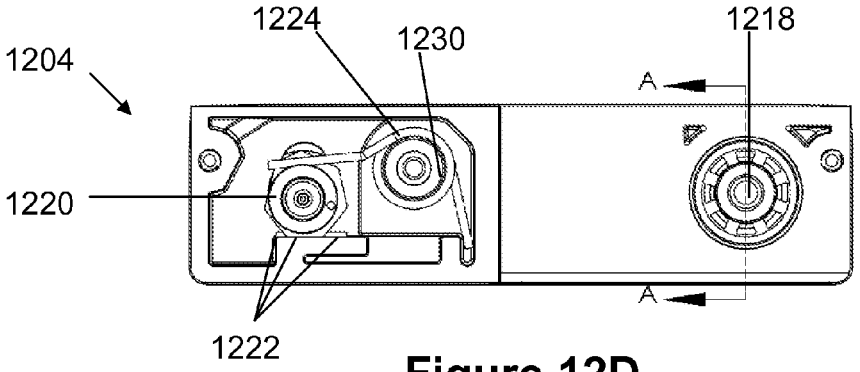

FIG. 12D is a left side, partial cutaway view of mount 1204, wherein the back plate has been removed to show the inner cam mechanism. As described above, when the registration shaft on a laser module is inserted into rotating docking hub 1214, the registration shaft engages cam 1220. Thus, in various embodiments, when a range knob on the laser sighting device is rotated, the resulting rotation of the registration shaft 112 may drive rotation of cam 1220.

In various embodiments, cam 1220 may engage cam base 1222, which provides a stationary surface for registration of cam 1220, and cam 1220 may come to rest in one of several flats along cam 1220 surface. Each of the flat sides of cam 1220 has a different thickness dimension and a different depth dimension, causing the distance to change between the center of cam 1220 and cam base 1222, and simultaneously causing the distance to change between rail mounting members 1218 and mount 1204, thus pivoting rail mounting members 1208 about pivot point 1218 in vertical and lateral directions to achieve the desired angular elevation. In various embodiments, cam 1220 may be held in place against cam base 1222 by torsion spring 1224, which may have one fixed leg and one dynamic leg configured to interface with a corresponding receiving groove in cam 1220, thus providing sufficient force to ensure that cam 1220 engages cam base 1222. A post torsion spring 1230 also may be provided that may provide the axis of rotation and capture torsion spring 1224, and that also may be threaded or capture a threaded insert that provides the threads to engage attachment screw 1216 (see, e.g., FIG. 12C)

Figure 12E:
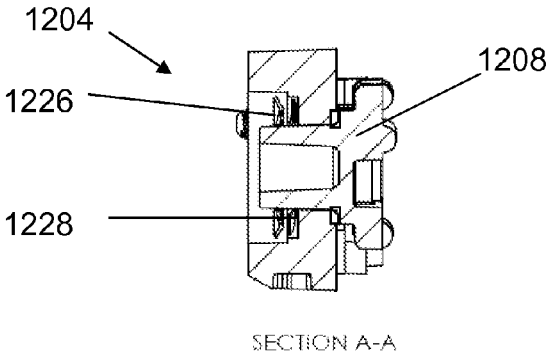

In various embodiments, the correct angular elevation may be derived from the ballistic characteristics of the launcher munition and referred to as the quadrant and elevation angles (Q & E). Although the illustrated cam may be suitable for use with many types of rounds, including A4-A7, A9, E8, E10, and ASM-RC, in various embodiments, different cams may be substituted for the illustrated cam if Q & E values are needed that are not provided by the illustrated embodiment. FIG. 12E is a cross sectional view taken through the line labeled "A" in FIG. 12D, and it shows the spatial relationships of disk spring 1226, corresponding self locking retaining ring 1228, and rail mounting member 1208.

Although the illustrated embodiments depict the mounting bracket as mounting to a top surface of the muzzle on an M 72LAW rocket launcher, in other embodiments it may be configured to couple to a bottom or side surface of a rocket launcher muzzle. Additionally, although the illustrated embodiments depict adapters that are configured for use with the M 72 LAW rocket launcher (Nammo Raufuss, Norway), one of skill in the art will appreciate that the adapter may be configured for use with other rocket launchers and large weapons, such as the MGM-1 Matador (Glenn L. Martin Co., Santa Ana, Calif.), FGM-148 Javelin (Raytheon/Lockheed Martin, Cambridge Mass.), and Carl-Gustaf M2GC recoilless rocket (Saab Bofors Dynamics, Linkoping, Sweden). One of skill in the art will appreciate that in order for the adapter to be configured for use with these or other weapons systems, the primary and/or secondary registration surfaces of the mounting bracket are simply configured to mate with and engage one or more features on the weapon housing, the strap length is configured to securely span the muzzle and secure the mounting bracket in position, and optionally, one or more cutouts may be provided to accommodate any accessories or other protruding features of the housing.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

We claim:

1. A laser sighting device mounting adapter for a rocket launcher comprising:

a mounting bracket having a top surface and a bottom surface, the bottom surface forming a void for receiving an iron sight, the void comprising a first registration surface positioned to contact a first side of the iron sight and a second registration surface positioned to contact a second side of the iron sight when the mounting bracket is coupled to the rocket launcher;

a laser sighting device mount coupled to the mounting bracket; wherein the laser sighting device mount detachably couples to a laser sighting device; and a strap configured to immobilize the mounting bracket on a muzzle of the rocket launcher, wherein coupling the mounting bracket to the rocket launcher aligns the laser sighting device mount with the rocket launcher for accurate sighting without additional calibration.

2. The laser sighting device mounting adapter of claim 1, wherein the mounting bracket further comprises a third registration surface positioned to contact a top surface of the iron sight when the mounting bracket is coupled to the rocket launcher.

3. The laser sighting device mounting adapter of claim 2, wherein the mounting bracket comprises a fourth registration surface positioned to contact a first portion of the rocket launcher when the mounting bracket is coupled to the rocket launcher.

4. The laser sighting device mounting adapter of claim 3, wherein the mounting bracket comprises a fifth registration surface positioned to contact a second portion of the rocket launcher when the mounting bracket is coupled to the rocket launcher.

5. The laser sighting device mounting adapter of claim 1, wherein the strap comprises an elastomeric member.

6. The laser sighting device mounting adapter of claim 5, wherein the strap comprises a first end and a second end, wherein the first end is coupled to a first side of the mounting bracket, and wherein the second end comprises a fastening member.

7. The laser sighting device mounting adapter of claim 6, wherein the fastening member comprises a hook member, and wherein the hook member removably couples to a second side of the mounting bracket.

8. The laser sighting device mounting adapter of claim 7, wherein the elastomeric member exerts pressure on the muzzle and helps retain the mounting bracket on the rocket launcher when the strap is n-coupled to the second side of the mounting bracket.

9. The laser sighting device mounting adapter of claim 1, wherein the mounting bracket comprises a cutout that accommodates a portion of the iron sight that projects through the cutout.

10. The laser sighting device mounting adapter of claim 9, wherein the portion of the iron sight that projects through the cutout comprises at least a portion of a pop-up iron sight.

11. The laser sighting device mounting adapter of claim 1, wherein the laser sighting device mount comprises a cam.

12. The laser sighting device mounting adapter of claim 1, wherein the mounting bracket mounts to a top surface of the rocket launcher.

13. The laser sighting device mounting adapter of claim 1, wherein the rocket launcher is an M72 LAW rocket launcher.

14. The laser sighting device mounting adapter of claim 1, wherein the rocket launcher is an MGM-1 Matador rocket launcher, an FGM-148 Javelin rocket launcher, or a Carl-Gustaf M2GC recoilless rocket launcher.

* * * * *